United States Patent [19]

Fazion

[11] Patent Number: 5,062,221

[45] Date of Patent: Nov. 5, 1991

[54] DRYING SYSTEM FOR PASTA OR SIMILAR PRODUCTS

[75] Inventor: Patrizio Fazion, Casaleone, Italy

[73] Assignee: Eurovo S.r.l., Santa Maria in Fabriago-Lugo, Italy

[21] Appl. No.: 471,302

[22] Filed: Jan. 26, 1990

[30] Foreign Application Priority Data

Feb. 2, 1989 [IT] Italy ..... 84909 A/89

[51] Int. Cl.[5] ..... F26B 19/00

[52] U.S. Cl. ..... 34/204; 34/218

[58] Field of Search ..... 34/203, 216, 217, 218, 34/206, 204

[56] References Cited

U.S. PATENT DOCUMENTS

| | | | |
|---|---|---|---|
| 1,219,081 | 3/1917 | Cass | 34/206 |
| 1,551,818 | 9/1925 | Garnsey | 34/203 |
| 2,368,130 | 1/1945 | Fox | 34/233 |
| 3,094,398 | 6/1963 | Samson | 34/203 |
| 3,214,844 | 11/1965 | Oates et al. | 34/216 |
| 3,277,580 | 10/1966 | Tooby | 34/203 |
| 3,323,227 | 6/1967 | Bassano | 34/203 |
| 4,126,945 | 11/1978 | Manser et al. | 34/17 |

*Primary Examiner*—Henry A. Bennet
*Assistant Examiner*—Denise L. F. Gromada
*Attorney, Agent, or Firm*—Guido Modiano; Albert Josif

[57] ABSTRACT

Drying system for flat thin pasta layers (lasagne) or thin pasta layers rolled to form cannelloni, comprising, in sequence, a loading station, a warm-air drying station, an unloading station and a conveyor which moves the pasta from the loading station to the unloading station through the drying station in a transverse direction with respect to the flow of drying air.

8 Claims, 2 Drawing Sheets

DRYING SYSTEM FOR PASTA OR SIMILAR PRODUCTS

BACKGROUND OF THE INVENTION

The present invention relates to a drying system or plant for pasta in thin layers arranged flat or rolled to form cannelloni or other similar shapes.

Predominantly manual systems for drying pasta in thin layers have been known for a long time; such systems use "frames" on which the thin pasta layers (lasagne of various sizes) are laid and dried by exposure to warm air. Said frames however have the disadvantage of presenting a considerable bulk in relation to the amount of treated product and also require an abundant and onerous use of labor.

The pasta layer which is simply laid on said frames furthermore tends to camber during drying. This is a penalizing disadvantage not only because of the scarcely appealing appearance of the dried product but also of the problems related to packaging, the considerably increased bulk and difficulties in classification, counting, etc.

SUMMARY OF THE INVENTION

The aim of the present invention is to provide a system which is capable of drying pasta in thin layers, in particular lasagne of various sizes, without causing their cambering, therefore allowing to obtain a dried product which is absolutely planar and uniform and therefore has an appealing appearance, lends itself to easy operations for classification and/or weighing for counting, is in regular pieces with a standard configuration and bulk and thus allows an easy and regular packaging operation.

An object of the present invention is to provide a system capable of ensuring high productivity though its dimensions are substantially smaller than hitherto known drying systems, as well as of great versatility in use in that it lends itself to the drying of products with different morphological characteristics, such as pasta layers, lasagne, cannelloni or the like.

A further object of the present invention is to provide a drying system with completely automatic operation, with the associated advantages in productive economy.

Another object of the present invention is to provide a system for drying pasta which is capable of drying pasta at a relatively high temperature, obtaining dried pasta with optimum organoleptic characteristics which comply with all the prescriptions or standards of the currently applicable laws in terms of bacteriological purity and of residual moisture content.

This aim and objects as well as other objects which will become apparent hereinafter are achieved by a drying system as defined in claim 1.

In particular, the pasta engagement and support means are adapted to arrange themselves along a variable mutual angle which first increases and then decreases to receive the pasta to be dried at the drying station and expel it at the unloading station and to maintain a constant mutual arrangement through the drying station so as to expose the pasta to the warm air which circulates therein.

The system can be advantageously equipped for drying various kinds of pasta obtainable from thin layers, such as cannelloni and the like, and can comprise two or more drying stations arranged in series so as to increase the pasta permanence time to obtain the required degree of residual moisture also according to the characteristics of composition and size of the pasta to be treated.

BRIEF DESCRIPTION OF THE DRAWINGS

Further aspects and advantages of the present invention will become apparent from the following description of an example of practical embodiment thereof, given by way of non-limitative example with reference to the accompanying drawings, wherein.

DESCRIPTION OF THE PREFERRED EMBODIMENTS

Figure 1:
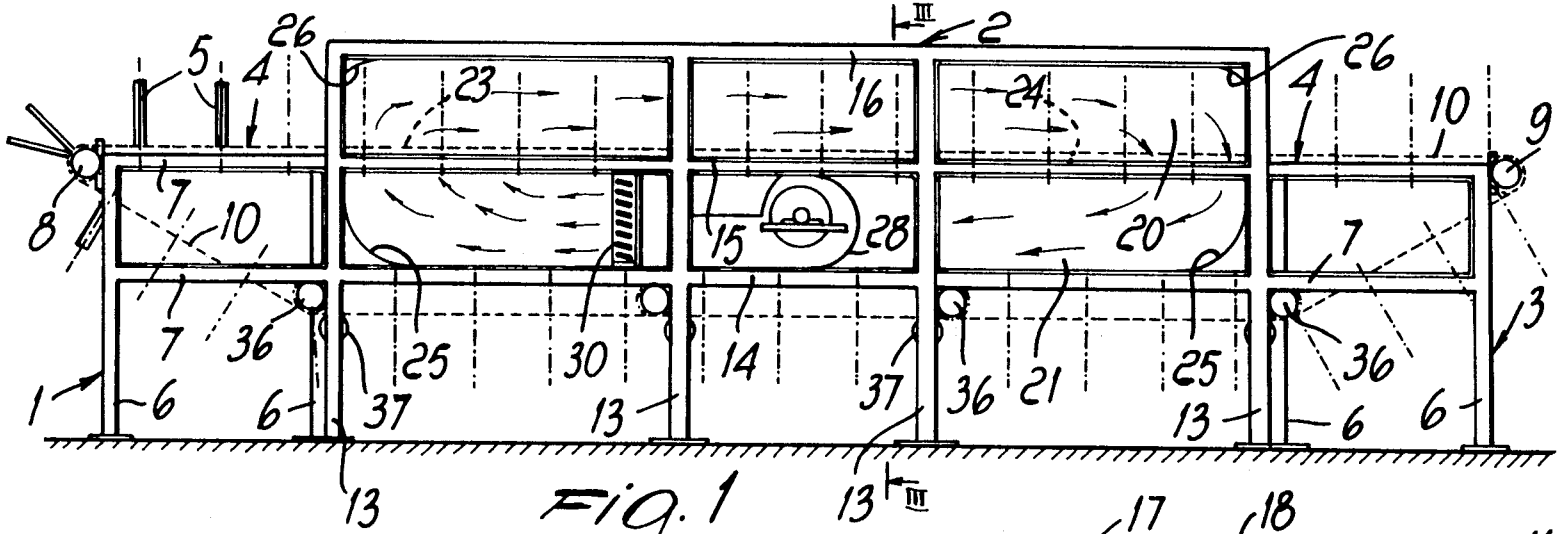
FIG. 1 is a lateral elevation view of a drying system with disassembled covering panels.

In the above listed figures, identical or similar parts or components have been indicated by the same reference numerals.

The illustrated system or plant is formed by a plurality of operative units or stations arranged one after the other, that is to say a loading station 1, one or more drying stations 2 and an unloading station 3. The various stations are connected and traversed by a chain conveyor 4 which has a plurality of engagement and support means 5 arranged uniformly spaced along the conveyor and intended to convey the pasta through the drying station or stations 2.

The loading station 1 and the unloading station 3 can be structurally identical, i.e. formed by a supporting frame comprising uprights 6 which also act as resting legs, and stringers 7, for example made of stainless steel tube, welded to the uprights. The frame supports a pair of lateral toothed wheels 8, located in the loading station, and 9, located in the unloading station, which are intended to transmit two chains 10 and 12 of the conveyor 4. An electric motor with related reduction gear, not illustrated, can be arranged on the frame of the loading or the unloading station for the actuation of the chains 10 and 12.

Figure 3:
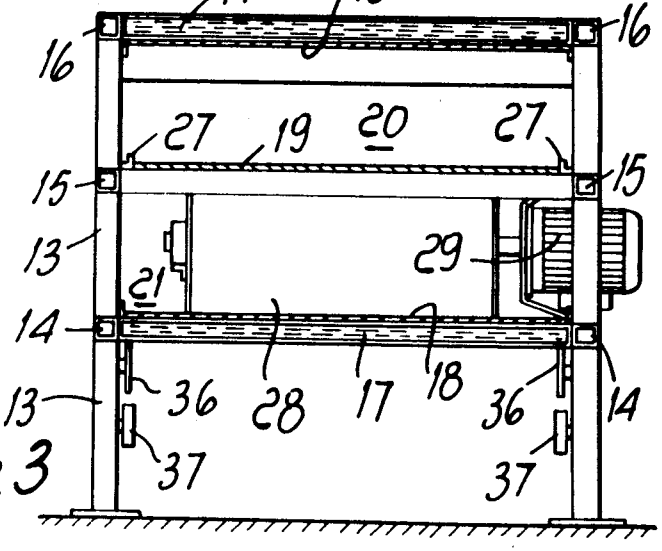
FIG. 3 is a sectional view of the system of FIG. 1 taken along the line III—III.

The or each drying station 2 is formed by a supporting frame including a plurality of uprights 13 which also act as supporting legs and by three rows of stringers 14, 15 and 16, for example made of stainless steel tube and welded to the uprights, which are arranged at three different levels. The supporting frame of station 2 has, at the stringers 14 and 16 (FIG. 3), a respectively bottom and top panelling, which in transverse cross section view is formed by one or more external thermally insulating panels 17 and by an internal covering 18 made of stainless steel sheet; whereas at the stringers 15 the frame supports a horizontal ledge 19 which divides the space inside the frame into two compartments: an upper tunnel-like one 20, extending substantially above and parallel to the chains 10 and 12, and a lower one 21. The ledge 19 does not extend for the entire length of the drying station 2 but only at its central region, thus defining free terminal regions, at which two openings 23 and 24 are thus delimited which directly connect to one another the compartments 20 and 21.

The inner covering 18 of the lower panelling is advantageously curved upward in an arc-like shape at the ends of each drying station 2, as indicated at 25 in FIG. 1, whereas the inner covering of the upper panelling is curved downward in an arc-like shape as indicated at 26.

The tunnel 20 is intended to be crossed longitudinally by the chains 10 and 12 of the conveyor 4 and for this purpose a pair of fixed rectilinear guides 27 is provided along the inner sides of the tunnel for the sliding support of said chains. The lower compartment 21 accommodates, for example at an intermediate region below the ledge 19, a blower 28 actuated by an electric motor 29 and a heat source for example a steam battery 30.

Figure 2:
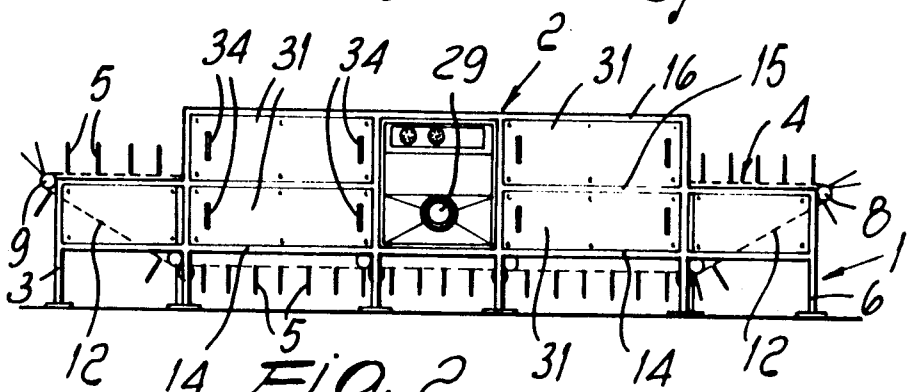
FIG. 2 is a reduced-scale view of the system of FIG. 1, seen from the opposite side, with installed covering panels.

On the sides, each opening or port delimited by the uprights and stringers is closed by a respective insulating covering panel 31 (FIG. 2) the inner face whereof is covered by a stainless steel sheet. Each panel 31 is advantageously mounted in a removable manner, for example by means of knobs 32 (FIG. 4), and is provided with respective handles 34 for its easy handling in case of removal for inspection, maintenance or for emergency interventions in the compartments 20 and 21.

Figure 4:
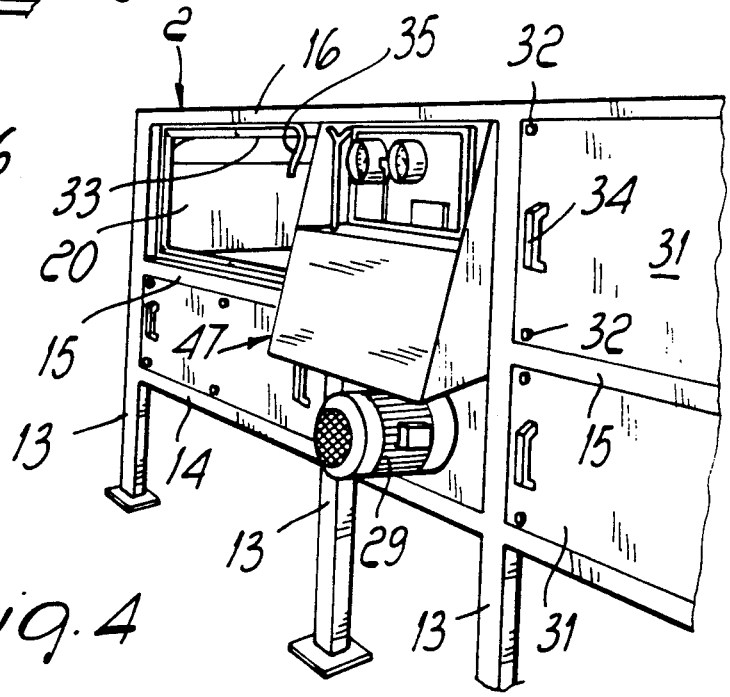
FIG. 4 is an enlarged-scale partial perspective view of the system of FIG. 2.

In order to ensure an adequate seal, the openings or ports on the sides intended to receive and be closed by a respective panel 31 can have a peripheral abutment 33 along which a sealing gasket 35 can be arranged (FIG. 4).

The chains 10 and 12 of the conveyor extend from the loading station 1 to the unloading station 3, passing through the tunnel 20. The upper portion constitutes the active portion or treatment path for the pasta to be treated; instead, the chains return portion, which moves from the unloading station to the loading station, extends below the stringers 14 of the or of each drying station 2 and is guided by a sequence of upper toothed wheels 36 and by lower supporting and resting pulleys 37.

The chains 10 and 12 support a succession of pasta engagement and support means 5 which can have various configurations, also depending on the specific shape of the pasta to be treated, for example flat pieces of pasta in thin layers or tubular pieces as in the case of cannelloni, fusilli etc.

Figure 5:
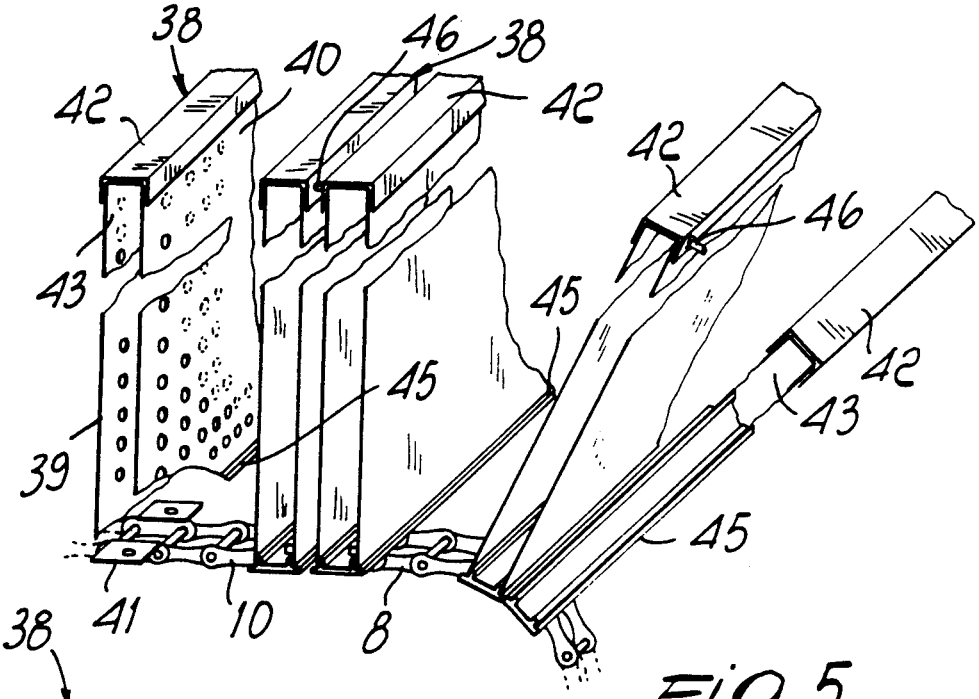
FIG. 5 is a perspective view of a detail of the conveyor of the drying system.
Figure 6:
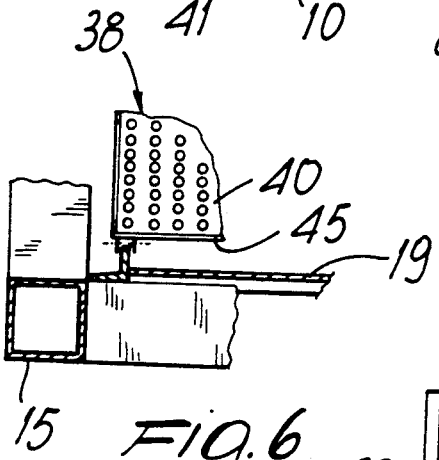
FIG. 6 shows a constructive detail of the conveyor of FIG. 5.

FIGS. 5 and 6 show a specific illustrative embodiment of supporting and engagement means 5 for drying lasagne, i.e. flat pasta pieces.

Said means are box-like elements or "pans" 38, each of which is constituted by a pair of planar perforated walls 39 and 40 which are mounted astride the chains 10 and 12 by means of lugs 41 fixed to the chains at respective links in said chains and are kept mutually spaced and stiffened by a U-shaped profiled element 42 at the top.

Each pair of walls 39 and 40 therefore delimits an internal space 43 and has its outer lower edge 45 folded in the shape of an L to define a shoulder or abutment between one pan and the other.

When two adjacent pans 38 are moved at the toothed transmission wheels 8 of the loading station 1, i.e. while they pass from the lower stringer of the conveyor to the upper one, they are first angularly moved apart, as can be seen in FIGS. 1 and 5, and in this configuration they can receive between themselves one or more pieces of thin pasta or lasagne from lasagne feeding means (not illustrated) and are then again forced to move mutually close, since they are both kept in a vertical arrangement at a preset distance which is set for example by the presence of an adapted spacer pin 46. Said vertical arrangement is kept along the entire treatment path through the tunnels of the or each drying station 2, until, once they have arrived above the transmission wheels 9 of the unloading station 3, they are again forced to move apart from one another and to lower, thus automatically dropping their load of thin pasta or lasagne.

The engagement and support means may naturally have a different structure from the above described one for the pans 38. E.g. the pans 38 could be constituted by a single perforated plate instead of two. Each pan 38 can also be replaced with a cage or box-like structure with perforated walls which instead of the U-shaped profiled element 42 is provided with a guide or hopper-like loading inlet.

Cross-members fixed and placed astride the chains 10 and 12 can furthermore be provided instead of the pans, each of said cross-members being provided with one or more pegs or pins arranged like the pans 38 and on which a piece of tubular pasta or the like, such as a cannellone or the like, is inserted at the loading station and is then automatically unloaded in the unloading station.

In order to ensure the control of the treatment conditions inside each drying station 2, adapted instruments can be provided for the detection and automatic control of the system, centralized in a console 47, at which the internal temperature of each tunnel 20 and the humidity of the circulation air can be read and more in general the parameters which rule the treatment conditions inside the drying station 2 can be controlled.

The operation of the above described drying system is very simple. Once the pasta has been loaded at the loading station on the engagement and support means 5, for example of the pan type 38, it is caused to enter the tunnel 20, where it is permanently struck by the flow of air generated by the blower 28 and heated by the battery 30. The air forced through the battery 30 is in fact deflected by the baffle 25 and moved upward through the opening 23 inside the tunnel 20, where the baffle 26 conveys it along said tunnel 20 against and through the pans which transit therein at that instant. Since the pans have perforated panels and also have spaces 43 between one another for the penetration and reflow of the warm air, the pasta is uniformly exposed and totally struck by the air which circulates in the tunnel. At the end of said tunnel, the wall 26 contributes to convey the air downward into the opening 24 to reach the blower 28, as indicated by the arrows in FIG. 1, and is facilitated in doing so by the corresponding baffle 25.

Advantageously, in systems where a plurality of drying stations 2 is provided in series, the stations can be arranged with an alternated pattern of the direction of circulation of the air inside them, i.e. once concurrent to the movement direction of the chains 10 and 12 and in countercurrent in the successive station, and so on.

In order to vary the treatment conditions it is possible to act either by varying the advancement rate of the conveyor 4, or by adjusting the temperature inside the tunnel or by altering the humidity of the air inside it, for example by injecting steam in the circulation air, or by means of any combination of the above described parameters.

The pasta is dried at high temperature, of the order of 100° C. or more. With a drying system 45 meters long, the time for which the pasta remains in the tunnel is approximately 1 hour, at the most 1½ hours (also depending on the thickness of the pasta) for an average production of 150 kg/hour.

Furthermore, and this is very important, a system according to the present invention furthermore ensures obtainment of a properly dry, uniform treated product with an appealing appearance, with a relative moisture content of approximately 11% which is an optimum value which complies perfectly with the requirements of the law which allow a maximum content of 12.5%. In the case of lasagne, the pans 38 prevent said lasagne from cambering or irregularly deforming during the drying process, but keep them perfectly planar, smooth and uniform, though they allow perfect exposure to the air which circulates in the tunnel. This is considerably important since it allows to perform the dosage of the final packages simply by counting the pieces (for example by means of known photoelectric-cell counting means) during the unloading operation at the station 3, the uniformity of said packages is ensured and a pleasant and appealing appearance of the packages, which do not swell in an awkward manner, and of the individual lasagne, which are completely flat, regular and uniform, is achieved.

I claim:

1. A drying system for pasta, comprising in sequence at least one loading station, at least one drying station with forced warm-air circulation defining a drying air flow, an unloading station and at least one conveyor for transferring pasta from the loading station to the unloading station through the drying station, said conveyor comprising a plurality of pasta engagement and support means arranged in sequence along said conveyor for placing pasta in an arrangement which is predominantly transverse with respect to the flow of drying air, said engagement and support means of the conveyor comprising a plurality of box-like receptacles with perforated walls for receiving each at least one portion of thin pasta layer at the loading station and keeping said portion in a planar arrangement during passage through the drying station up to the unloading station.

2. A system according to claim 1, wherein said receptacles are formed by two complementary elements which are pivoted to the conveyor for arranging themselves along a variable angle for mutual spacing and approaching so as to open and receive pasta to be dried at the loading station and to reopen and move the pasta away at the unloading station.

3. A system according to claim 2, wherein said complementary elements comprise each a planar perforated wall mounted astride said conveyor by means of lugs fixed to a respective chain link of the conveyor, said walls being kept mutually spaced and being stiffened by a U-shaped profiled element at the top.

4. A system according to claim 1, wherein the drying station comprises a tunnel passed by the conveyor which has a first and a second end, defining an input end and an output end, warm air generating means and blower/injection means for feeding air produced by the generating means at the first end of the tunnel and to recover it at the second end.

5. A system according to claim 4, wherein said drying station comprises a chamber for accommodating said warm air generating means and said blower/injection means, said chamber being arranged adjacent to the tunnel and is connected thereto through a duct for forced delivery of warm air and a return duct, so as to create, in operation, a forced flow with a substantially closed circuit in the drying station.

6. A system according to claim 4, wherein said perforated walls delimit an internal space, each said perforated wall further defining an L-shaped outer lower edge forming an abutment between said receptacles.

7. A system according to claim 1, further comprising means for controlling temperature and humidity of air inside the drying station.

8. Pasta drying apparatus comprising a drying station defining a tunnel compartment means, said drying station being provided with means for feeding warm air to said tunnel compartment means, pasta conveyor means being provided for conveying pasta through said tunnel compartment means, wherein said pasta conveyor means comprise a plurality of flat pasta engagement and support means each for accommodating a flat-type pasta portion and each being constituted by a box-like receptacle means, said box-like receptacle means defining a wall means which delimits an internal space, said internal space of said box-like receptacle means being shaped correspondingly to the flat-type pasta portion shape for accommodation therein, whereby the flat-type pasta portion maintains a substantially flat and uncambered shape upon drying thereof inside said tunnel compartment means.

* * * * *